US006227423B1

(12) United States Patent
Gates

(10) Patent No.: US 6,227,423 B1
(45) Date of Patent: May 8, 2001

(54) CLOTHES HANGER PAD

(75) Inventor: Maxwell Gates, Palm Beach Gardens, FL (US)

(73) Assignee: Signal Industries, Inc., Boston, MA (US)

( * ) Notice: Subject to any disclaimer, the term of this patent is extended or adjusted under 35 U.S.C. 154(b) by 325 days.

(21) Appl. No.: 08/760,303

(22) Filed: Dec. 4, 1996

(51) Int. Cl.[7] ..... A47G 25/14
(52) U.S. Cl. ..... 223/98
(58) Field of Search ..... 223/85, 98

(56) References Cited

U.S. PATENT DOCUMENTS 2,178,965 * 11/1939 Johnson ..... 223/98
2,739,745 * 3/1956 Tufts ..... 223/98
2,828,899 * 4/1958 Zuckerman ..... 223/98
3,071,298 * 1/1963 Tufts ..... 223/98
3,212,687 * 10/1965 Bradley ..... 223/98
5,056,964 * 10/1991 Michalik ..... 223/98

FOREIGN PATENT DOCUMENTS

5293029 * 11/1993 (JP) ..... 223/98
6205724 * 7/1994 (JP) ..... 223/98

* cited by examiner

*Primary Examiner*—Bibhu Mohanty
(74) *Attorney, Agent, or Firm*—Wolf, Greenfield & Sacks, P.C.

(57) ABSTRACT

A clothes hanger pad comprising a foam piece having a first edge opposite a second edge and a third edge opposite a fourth edge, and a layer of a dimensionally stable material laminated to a first side of the foam piece. The foam piece is folded along a midline of the foam piece, the midline being parallel to the first and second edges, so that the first side is folded against itself. The third edge is attached to itself and the fourth edge is attached to itself to form a pocket having, as an inside surface, the first side of the foam piece. A clothes hanger pad is mounted on each end of a conventional hooked clothes hanger.

22 Claims, 1 Drawing Sheet

CLOTHES HANGER PAD

FIELD OF THE INVENTION

The present invention relates to a clothes hanger pad, and more particularly to a clothes hanger pad which is dimensionally stable, interchangeable between clothes hangers and which can be retrofit to conventional clothes hangers.

BACKGROUND OF THE INVENTION

Many types of garments which are hung onto clothes hangers have a tendency to slide off conventional clothes hangers. Such garments may be blouses which have wide neck openings or tank top-type garments. Furthermore, garments made from slippery materials such as silk or nylon may also slide off of convention clothes hangers.

Many clothes hangers are available which are directed to the problem set forth above. These include hangers having a non-slip material which is attached to the clothes hanger through various manufacturing processes. U.S. Pat. No. 5,277,345, issued Jan. 11, 1994, discloses a hanger having heat shrinkable tubes which are fitted on the ends of a clothes hanger and that are shrunk onto the ends by heating them until the tubes are secured to the hanger. Such a heat shrinking process adds to the cost of the clothes hanger and does not permit the tubes to be removed from the hanger for use on a different hanger. U.S. Pat. No. 5,078,307, issued Jan. 7, 1992, discloses a plastic hanger having a flocking material sprayed over the hanger to provide a non-slip surface. This configuration requires the extra step of spraying the flocking material on the hanger, and the flocking material is not removable. U.S. Pat. No. 5,056,694, issued Oct. 15, 1991, discloses a clothes hanger having heavy rubber pads which are fastened to the ends of the clothes hanger. These pads may be expensive to produce and install. Some clothes hangers have foam glued to each end of the clothes hanger in order to prevent the garment from slipping off the hanger. All of these clothes hangers require the user to purchase the entire hanger to take advantage of the non-slip features.

Other types of clothes hanger pads include foam pockets which are stretched over the ends of clothes hangers in order to provide a non-slip surface at the end of the hangers. Some have foam pieces which are stretched from one end of the hanger to the other end over the top of the hanger in order to provide a non-slip surface for the garment to hang on. However, these foam pockets tear easily, quickly deform through stretching, are not reliable for long-term use and must be replaced frequently. Many of these foam pockets cover most of the coat hanger arms and are not particularly aesthetically attractive.

SUMMARY OF THE INVENTION

Thus, it is desirable to provide a clothes hanger pad which is inexpensive to produce, dimensionally stable, durable and interchangeable between clothes hangers, so that a person who requires non-slip clothes hangers does not need to purchase complete new hangers. Rather, the person would only need to purchase the clothes hanger pad provided by the present invention, which can be fit onto conventional hooked clothes hangers.

One object of the present invention is to provide a simple, inexpensive coat hanger pad that is simple to secure to a coat hanger in a manner in which the aesthetic appearance of a decorative coat hanger is not materially affected.

Another object of the present invention is to provide a non-slip clothes hanger cover which is entirely concealed by the garment which is carried by the hanger on which the cover is mounted thereby avoiding an unsightly display when garments are offered for sale.

In a preferred embodiment, a clothes hanger pad is disclosed comprising a foam piece having a first edge opposite a second edge and a third edge opposite a fourth edge, and a dimensionally stable material laminated to a first side of the foam piece. The foam piece is folded along a midline of the foam piece, the midline being parallel to the first and second edges, so that the first side is folded against itself. The third edge is attached to itself and the fourth edge is attached to itself to form a pocket having, as an inside surface, the first side of the foam piece. The dimensionally stable material is a material selected from the group consisting of thermoplastic urethane, plastic film, flexible PVC, neoprene rubber, natural rubber, nitrile and low density polyethylene, and has a thickness of approximately 1 to 3 mils. The foam piece is a material selected from the group of polyester and polyether, has a thickness of approximately 0.0625 inches to 0.5 inches and a density of approximately 1.0–2.0 pounds per square foot. The third and fourth edges are respectively attached to the themselves by gluing, using heat to melt the edges together, by electronic impulse bonding, or by stitching the edges together. The dimensionally stable material is either heat bonded to the first side or bonded with an adhesive to the first side.

In another embodiment, a clothes hanger pad is disclosed comprising a foam pocket having a first bonded side, a second bonded side, a folded side, an open side, and a dimensionally stable material laminated to an inside surface of the pocket.

In another embodiment, a method of making clothes hanger pads is disclosed, the method comprising the steps of laminating a foam strip with a dimensionally stable material on a first side thereof, folding the strip so that the first side is folded against itself, bonding the strip to itself at a plurality of discrete locations along the strip and cutting the strip at the plurality of discrete locations to form a plurality of clothes hanger pads. In the laminating step, a dimensionally stable material selected from the group consisting of thermoplastic urethane, plastic film, flexible PVC, neoprene rubber, natural rubber, nitrile and low density polyethylene is heat bonded to the first side.

In another embodiment, a clothes hanger pad is disclosed having an elongated pocket shape adapted to engage the end of a coat hanger, formed of a laminate including an outer layer of a flexible resilient foam material and an inner layer that is more dimensionally stable but thinner than the outer layer with the two layers bonded together.

DETAILED DESCRIPTION

Figure 1:
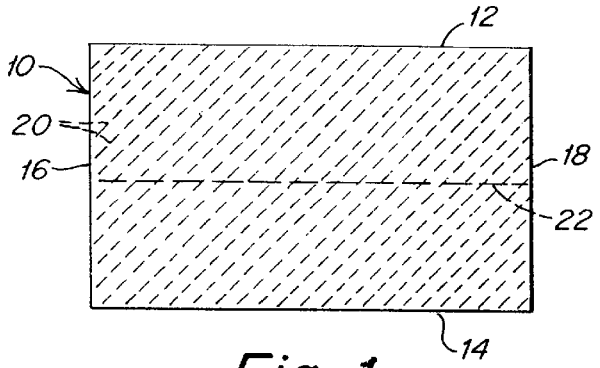
FIG. 1 is a schematic of a foam piece which is used in the construction of the clothes hanger pad of the present invention.

FIG. 1 shows a schematic of a foam piece 10 which is used in the formation of the clothes hanger pad of the present invention. Foam piece 10 is rectangular in shape and includes a first edge 12, a second edge 14, a third edge 16, and a fourth edge 18. Foam piece 10 is typically formed by die-cutting a large foam sheet (not shown) into several foam pieces. Edges 12 and 14 are opposite each other, and edges 16 and 18 are opposite each other. In the preferred embodiment, foam piece 10 is made from a flexible, resilient foam material such as a polyester foam, a polyether foam, or a combination of these materials. The foam used has a density of approximately 1.0–2.0 pounds per square foot and a thickness of between 0.0625–0.5 inches. A layer of a dimensionally stable material, indicated by dashed lines 20, is laminated to one side of foam piece 10. Layer 20 causes foam piece 10 to be dimensionally stable, which maintains the elasticity of foam piece 10, prevents foam piece 10 from losing its shape or deforming, and makes the clothes hanger pad less prone to tearing. Several dimensionally stable materials may be used as layer 20 in the preferred embodiment, including thermoplastic urethane, plastic film, flexible PVC, neoprene rubber, natural rubber, nitrile and low density polyethylene. The thickness of the layer of dimensionally stable material applied to foam piece 10 is typically in the range of 1–3 mils (1/1000"–3/1000"). Layer 20 is applied either by heating layer 20 and bonding it to foam piece 10, or by applying an adhesive to layer 20 and bonding it to foam piece 10.

Figure 2:
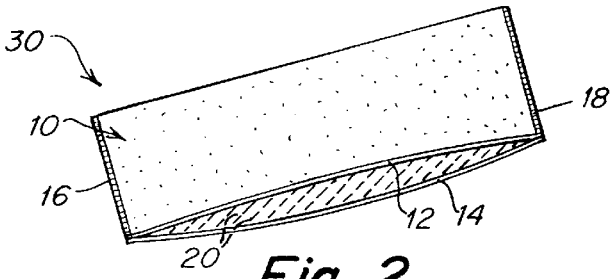
FIG. 2 is a schematic of the clothes hanger pad.

Edge 12 is then folded toward edge 14 along a mid-line, indicated in FIG. 1 by dashed line 22. After edge 12 is folded to meet edge 14, edge 16 is bonded to itself and edge 18 is bonded to itself to form the clothes hanger pad shown in FIG. 2. Edges 16 and 18 are respectively bonded to themselves by using hot wires to heat foam piece 10 and melt edge 16 to itself and edge 18 to itself. Electronic impulse bonding may also be used to bond the edges together, or the edges may be stitched together. In clothes hanger pad 30 shown in FIG. 2, edge 12 has been folded to edge 14, edge 16 has been bonded to itself, and edge 18 has been bonded to itself. The interior portion of clothes hanger pad 30 is lined by layer 20.

Figure 3:
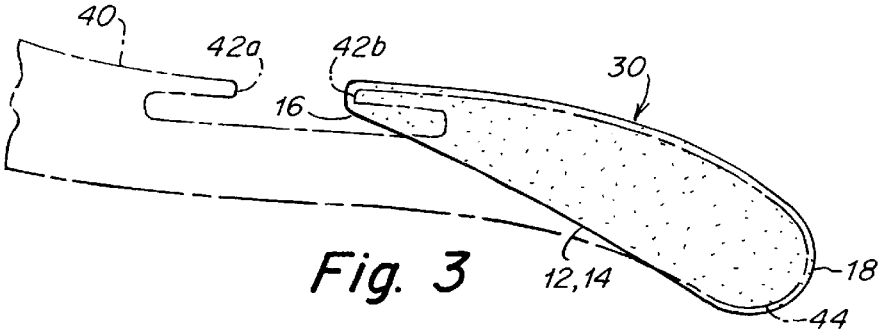
FIG. 3 is a schematic showing how the clothes hanger pad of FIG. 2 is used on a clothes hanger.

FIG. 3 shows how clothes hanger pad 30 is mounted on a conventional hooked clothes hanger 40, shown in dashed lines. For simplicity, only one end of clothes hanger 40 is shown. Clothes hanger 40 includes hooks 42*a* and 42*b* and an end 44. In use, one end of clothes hanger pad 30, the end defined by bonded edge 16, for example, is placed over hook 42*b* and the other end of clothes hanger pad 30, the end defined by bonded edge 18, for example, is placed over end 44 of clothes hanger 40. The clothes hanger pad 30 is stretched from hook 42*b* to end 44, resulting in a secure fit of clothes hanger pad 30 to the end of clothes hanger 40. Although not shown in the figure, another clothes hanger pad would be mounted on the other end of hooked clothes hanger 40.

Figure 4A:
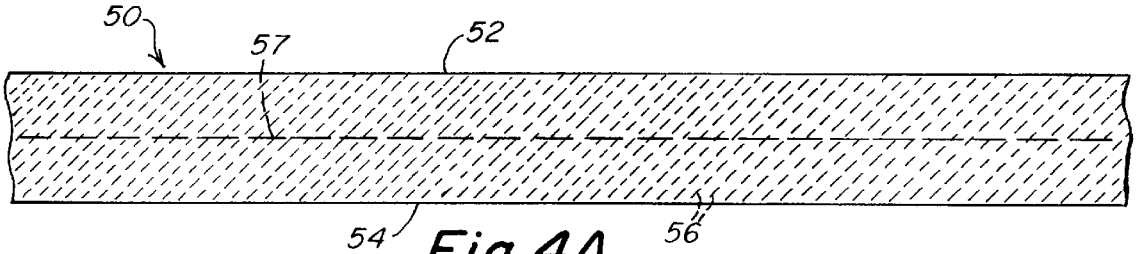
FIGS. 4A and 4B are schematics which show another embodiment of how the present invention is formed.
Figure 4B:
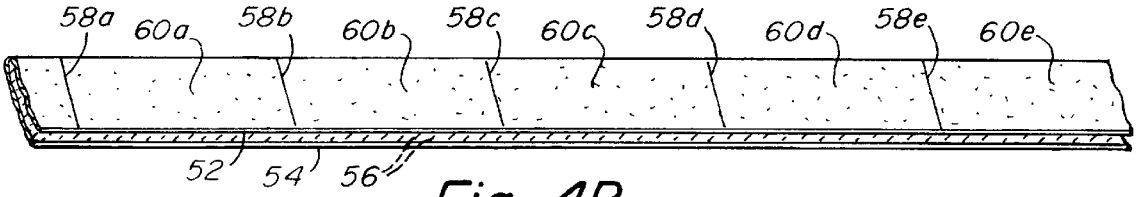

In another embodiment, shown in FIGS. 4A–4B, a long foam strip 50, having a top edge 52 and a bottom edge 54 is laminated as described above with a layer of a dimensionally stable material, indicated by dashed lines 56 (FIG. 4A). Foam strip 50 is formed with the same materials and specifications discussed above with reference to foam piece 10 of FIG. 1. Foam strip 50 then is folded along a midpoint, indicated in FIG. 4A by dashed line 57, such that top edge 52 meets bottom edge 54, as shown in FIG. 4B. Layer 56 is located on the inside of the folded strip. Strip 50 then is bonded to itself at discrete locations indicated by lines 58*a*–58*e*. The strip is bonded by heating the foam to melt the foam together at lines 58*a*–58*e*, by using electronic impulses to bond the foam together or by stitching the foam together along lines 58*a*–58*e*. Strip 50 is then cut at lines 58*a*–58*e* to form clothes hanger pads 60*a*–60*e*, which are similar to clothes hanger pad 30 of FIG. 2. The bonds formed along lines 58*a*–58*e* are of a sufficient width to enable strip 50 to be cut along lines 58*a*–58*e* while insuring that each of clothes hanger pads 60*a*–60*e* remain bonded at each end. In this embodiment, a plurality of foam strips 50 may be cut from a laminated foam sheet (not shown). Each of the foam strips then is processed as described above.

The above-described invention is advantageous because the layer of material laminated to the foam piece provides the clothes hanger pad with dimensional stability. This allows the clothes hanger pad to be stretched over the end of the clothes hanger without tearing or losing its shape after several installations and removals of the clothes hanger pad from various clothes hangers. Furthermore, it is retrofittable to conventional hooked clothes hangers. Therefore, a user need only purchase the clothes hanger pads and does not need to purchase the entire hanger, as is the case with the hangers discussed in the Background of the Invention section. Also, the clothes hanger pad of the present invention may be made to be any length or width to fit a variety of different size clothes hangers.

Having thus described embodiments of the invention, various alterations, modifications and improvements will readily occur to those skilled in the art. Such alterations, modifications and improvements are intended to be within the spirit and scope of the invention. Accordingly, the foregoing description is by way of example only and is not intended to be limiting.

What is claimed is:

1. A clothes hanger pad comprising:

a foam piece having a first edge opposite a second edge and a third edge opposite a fourth edge; and a layer of a dimensionally stable material laminated to a first side of said foam piece;

wherein said foam piece is folded along a midline of said foam piece, said midline being parallel to said first and second edges, so that said first side is folded against itself; and wherein said third edge is attached to itself and said fourth edge is attached to itself to form a pocket having, as an inside surface, said first side of said foam piece.

2. The clothes hanger pad of claim 1, wherein said dimensionally stable material is selected from the group consisting of thermoplastic urethane, plastic film, flexible PVC, neoprene rubber, natural rubber, nitrile and low density polyethylene.

3. The clothes hanger pad of claim 2, wherein said layer of dimensionally stable material has a thickness of approximately 1 to 3 mils.

4. The clothes hanger pad of claim 1, wherein said foam piece comprises a material selected from the group of polyester and polyether.

5. The clothes hanger pad of claim 4, wherein said foam piece has a thickness of approximately 0.0625 inches to 0.5 inches.

6. The clothes hanger pad of claim 1, wherein said third and fourth edges are respectively attached to the themselves using heat to melt the edges together.

7. The clothes hanger pad of claim 1, wherein said third and fourth edges are respectively stitched to themselves.

8. The clothes hanger pad of claim 1, wherein said third and fourth edges are respectively attached to themselves by electronic impulse bonding.

9. The clothes hanger pad of claim 1, wherein said foam piece has a density of approximately 1.0–2.0 pounds per square foot.

10. The clothes hanger pad of claim 1, wherein said layer of dimensionally stable material is heat bonded to said first side.

11. The clothes hanger pad of claim 1, wherein said layer of dimensionally stable material is bonded with an adhesive to said first side.

12. A clothes hanger pad comprising:

a foam pocket having a first bonded side, a second bonded side, a folded side, an open side, and a layer of a dimensionally stable material laminated to an inside surface of said foam pocket;

wherein said clothes hanger pad is mounted on an end of a clothes hanger.

13. The clothes hanger pad of claim 12, wherein said dimensionally stable material is selected from the group consisting of thermoplastic urethane, plastic film, flexible PVC, neoprene rubber, natural rubber, nitrile and low density polyethylene.

14. The clothes hanger pad of claim 13, wherein said layer of dimensionally stable material has a thickness of approximately 1 to 3 mils.

15. The clothes hanger pad of claim 12, wherein said foam pocket comprises a material selected from the group of polyester and polyether.

16. The clothes hanger pad of claim 15, wherein said material has a density of approximately 1.0–2.0 pounds per square foot.

17. The clothes hanger pad of claim 12, wherein said layer of dimensionally stable material is heat bonded to said inside surface.

18. A method of making clothes hanger pads, the method comprising the steps of:

laminating a foam strip with a dimensionally stable material on a first side thereof;

folding said strip so that said first side is folded against itself;

bonding said strip to itself at a plurality of discrete locations along said strip; and cutting said strip at said plurality of discrete locations to form a plurality of said clothes hanger pads.

19. The method of claim 18, wherein, in said laminating step, a material selected from the group consisting of thermoplastic urethane, plastic film, flexible PVC, neoprene rubber, natural rubber, nitrile and low density polyethylene is attached to said first side.

20. The method of claim 19, wherein said material is heat bonded to said foam piece.

21. A clothes hanger pad having an elongated pocket shape adapted to engage the end of a coat hanger and to be substantially concealed by a garment mounted on the hanger, said pad formed of a laminate including an outer layer of a flexible resilient foam material and an inner layer that is more dimensionally stable but thinner than the outer layer with the two layers bonded together.

22. A clothes hanger pad having a pocket shape adapted to engage the end of a coat hanger and to be substantially concealed by a garment mounted on the hanger, said pad formed of a laminate including one layer of a flexible resilient foam material and another layer that is more dimensionally stable but thinner than the one layer, with the two layers bonded together.

* * * * *